US005765230A

United States Patent [19]

Sivret et al.

[11] Patent Number: 5,765,230

[45] Date of Patent: Jun. 16, 1998

[54] MULTIFUNCTION HEAD APPAREL

[76] Inventors: Robert Darryll Sivret, 3416 62nd SW., Seattle, Wash. 98116; Dave Ross Maclaskey, 12741 NE. Glisan, Portland, Oreg. 97230

[21] Appl. No.: 759,552

[22] Filed: Dec. 4, 1996

[51] Int. Cl.[6] ..... A42B 1/04

[52] U.S. Cl. ..... 2/202; 2/203

[58] Field of Search ..... 2/202, 4, 171, 2/203, 204, 205, 410

[56] References Cited

U.S. PATENT DOCUMENTS 1,398,165 11/1921 Whiteside ..... 2/202

*Primary Examiner*—Diana Biefeld

*Attorney, Agent, or Firm*—Garrison & Associates PS

[57] ABSTRACT

A multifunction head apparel is disclosed and configurable into a variety of protective forms to provide varying degrees of protection of a user's head and face from the surrounding environment. The accessory is characterized as having a hood portion which defines a face opening sufficient in size so as to permit a head to extend there through, and a neck portion wherein the neck portion has a proximal portion adjacent to the hood portion and a distal portion terminating at a neck opening. The length of the neck portion is sufficient to permit full coverage of the neck when the neck opening is involuted to terminate at or near the mid point of the face opening, thereby forming a dual layer of material surrounding the neck. In this manner, a single accessory can be configured to provide a hood with or without a face mask; a neck tube, with or without a face mask; and a hat. A drawstring located in a hem positioned at the neck opening operates to minimize the escapement of a user's breath through the gap created by the nose, cheeks, and distal portion of the neck portion when the accessory is configured to have a face mask. A gasket may be incorporated at the hem to provide further means by which the escapement of a user's breath may be minimized. Features of the invention include the use of a draw string/hem combination about the face opening, water-proof liners or materials, and an integral bill to reduce impingement of rain or snow on a user's face.

11 Claims, 2 Drawing Sheets

FIG. 1
PRIOR ART
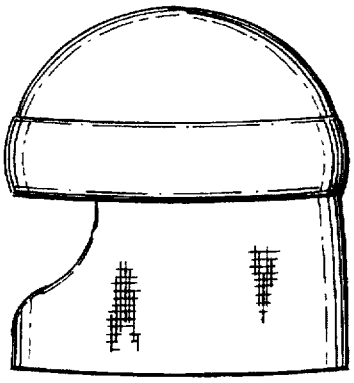
FIG. 2
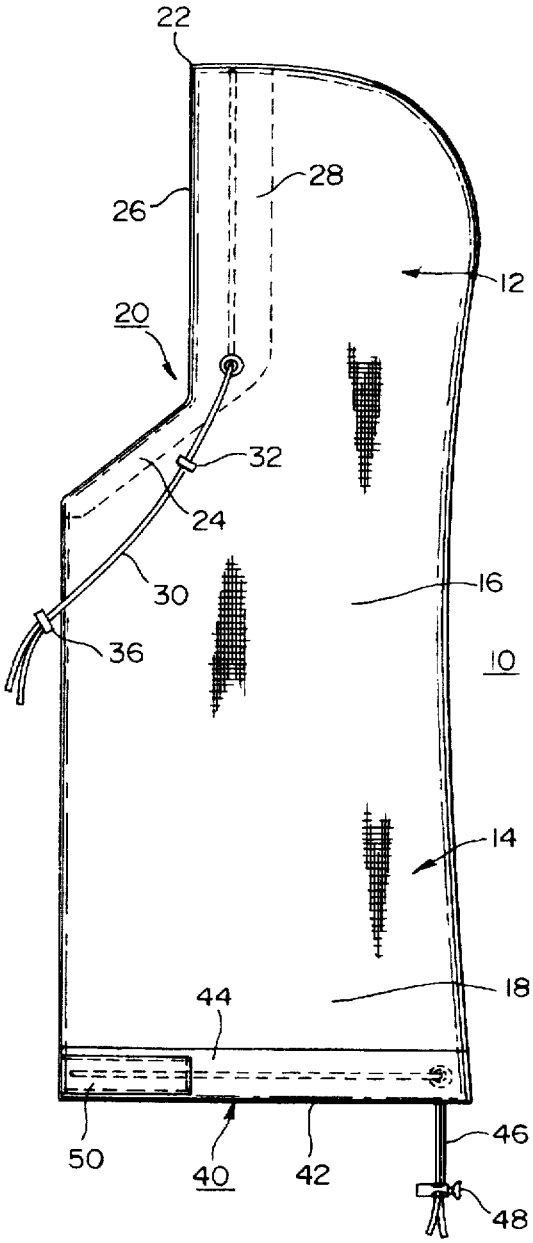
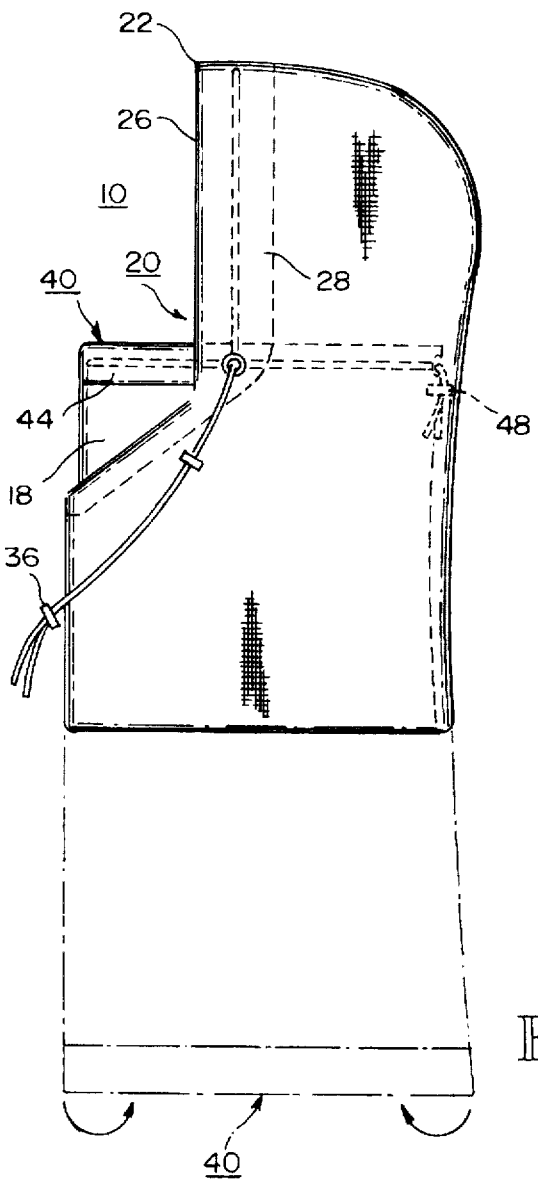
FIG. 3

MULTIFUNCTION HEAD APPAREL

FIELD OF THE INVENTION

The present invention pertains to a clothing accessory for a person's head and more particularly to an integrated hood and neck tube which permits selective manipulation to form a variety of functional forms.

BACKGROUND OF THE INVENTION

It is well known that a significant percentage of a person's body heat is radiated through his or her head. For this reason, among others such as style, hats of various forms are worn by persons to protect themselves from radiant and convection heat loss when the ambient temperature is to varying degrees lower than the comfort temperature. In environments where the apparent temperature (the ambient temperature in addition to factors such as humidity and wind speed) is much below the comfort temperature, it is desirable to wear a hat that has maximum head and facial covering portions. These hats, generally referred to as face masks, beneficially protect most of a person's head, leaving exposed only the person's eyes.

A limitation to this design, however, is that the user must either wear the mask or not use it at all. In response to this limitation, certain manufactures of cold weather apparel designed a combination hat and mask: the article resembled a knit type hat but had stored in the inner head portion thereof a mask portion that could be folded out and extended about the user's face. An example of this type of article is shown in FIG. 1. This design, however, did little to protect the user's neck. And if a neck portion were incorporated into the mask portion, one could not just use the neck portion.

It is of course possible to wear a scarf or neck tube in conjunction with a hat or face mask, however, storage of one, the other, or both may often time be undesirable. It is therefore desirable to have a single apparel head accessory that can function as a hat, a face mask, and a neck tube in various user defined combinations.

SUMMARY OF THE INVENTION

The present invention is directed to a one piece multifunction clothing accessory for selectively covering a human head and neck comprising a hood portion sized to cover the upper scalp portion and rear head portion of the human head, the hood portion defining a first opening to permit exposure of the face portion of the human head and extension of the head there through; an elongated neck portion characterized as having a substantially cylindrical shape, a length approximately at least twice the average distance between the head and shoulders of a human, and a diameter sufficient to permit extension of the head there through, the neck portion having a proximal portion adjacent the hood portion and a distal portion terminating at a second opening; and a first circumferential gathering means located adjacent the second opening for causing the second opening to constrict radially. The design of the accessory permits it to be selectively configured so as to operate as a hood by involuting the distal portion of the neck portion into itself up to a first position that is prior to the location of the first opening and inserting the head through the second opening until the scalp can contact the hood portion; as a neck tube by carrying out the steps described for a hood and further by permitting the head to extend through the first opening; as a neck tube with facial protector by carrying out the steps described for the neck tube and extending the distal portion of the neck portion over the chin, mouth, nose, and ears; as a hood with chin, mouth, nose, and ear shield by carrying out the steps described for the neck tube with facial protector and bringing the hood portion over the upper portion of the head; and as a hat by extending the head only partway through the involuted second opening.

A feature of the invention is the incorporation of a gathering means adjacent the second opening to enhance the insulating and sealing characteristics of the accessory. In this manner, when the distal portion of the neck portion is brought into contact with the face, the gathering means will enhance the contact between the distal portion and the face to reduce the escapement of a user's breath that might cause undesirable fogging of glasses, goggles, and the like. A gasket may be beneficially attached to the distal portion of the neck portion at a location corresponding to a user's nose area when the invention is configured to have a facial protector. The gasket operates to enhance the seal created by use of the gathering means and may be formed to fit the contours of the user's face, be it the nose bridge or the upper mouth area.

Further features of the invention include the incorporation of a fluid impervious material, either as the base material or in conjunction therewith to reduce the penetration of water and the like that may be encountered during use of the invention. Another feature includes the addition of a bill structure to reduce the impingement of rain or snow on the user's face. Yet another feature is the use of a gathering means to selectively constrict the first opening so as to vary the degree of hood portion coverage of a user's face.

These features and others will become apparent upon review of the following description and drawings.

BRIEF DESCRIPTION OF THE DRAWINGS

FIG. 1 is a side elevation view of an integrated hat and face mask publicly available prior to the invention;

FIG. 2 is a side elevation view of an embodiment of the invention illustrating the portions thereof;

FIG. 3 is a view similar to FIG. 2 wherein the neck portion of the invention has been involuted to form a face shield portion;

DESCRIPTION OF THE INVENTION

Figure 4:
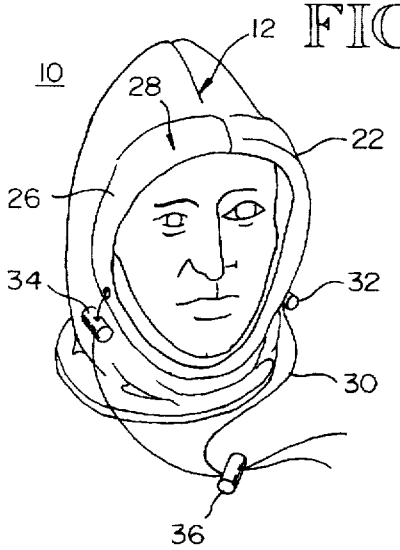
FIG. 4 is a perspective view of the invention when worn by a human showing the invention in a hood configuration.
Figure 5:
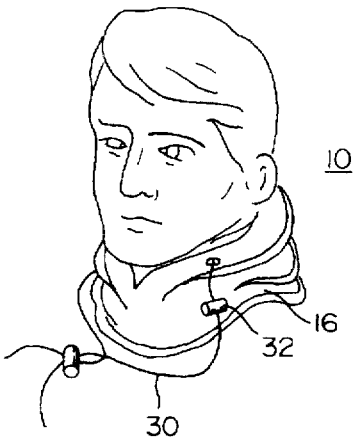
FIG. 5 is a perspective view of the invention when worn by a human showing the invention in a neck tube configuration.
Figure 7:
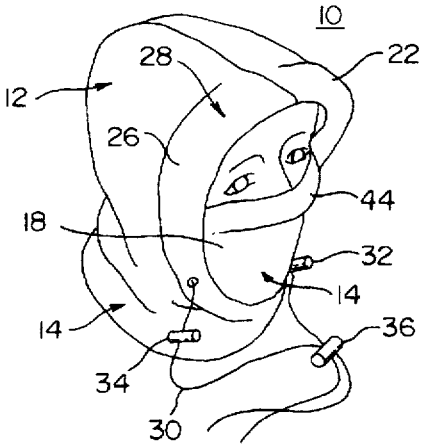
FIG. 7 is a perspective view of the invention when worn by a human showing the invention in a hood with lower face mask configuration.
Figure 8:
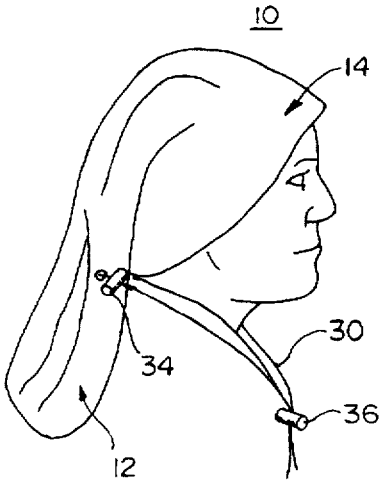
FIG. 8 is a perspective view of the invention when worn by a human showing the invention in a mambo hat configuration.

Referring then to the several Figures wherein like numerals indicate like parts and more particularly to FIG. 2, an embodiment of the invention is shown in its unmodified form. Apparel accessory 10 is preferably constructed from a single piece of comfortable insulative material such as knit or woven cotton, wool, or polymer material. Accessory 10 has two major portions namely hood portion 12 and neck portion 14. Hood portion 12 defines a first opening designated as head opening 20. Head opening 20 is sized so as to permit complete exposure of a human face when accessory 10 is worn as a hood (see FIG. 4), and complete extension of a human head there through when accessory 10 is worn as a neck tube (see FIG. 5). Head opening 20 is defined by upper perimeter 22, lower perimeter 24, and lateral perimeter 26. Draw string 30 is located in hem 28 to permit constriction of upper perimeter 22 and lateral perimeter 26 about the forehead region of a human head when used in configurations such as shown in FIGS. 4 and 7. For versatility, separate toggles 32 and 34, which are well known in the industry, are used in conjunction with draw string 30. In this manner, head opening 20 can be constricted via draw string 30 without interfering with the user's comfort. Toggle 36 maintains both ends of draw string 30 in close contact so as to form a loop which may be used for tethering purposes when the accessory, for example, is used as a mambo hat as is shown in FIG. 8.

Neck portion 14 is integral with hood portion 12 but performs a distinctly different function. Neck portion 14 is generally a cylindrical section of material having proximal portion 16 located adjacent hood portion 12 and distal portion 18 having associated therewith neck opening 40 defined by perimeter 42 to permit the entry of a human head when accessory 10 is worn. Neck portion 14 has a length generally equal to twice the average distance between a person's head and their shoulders. As is shown most clearly in FIGS. 2 and 3, neck portion 14 preferably has a length at least approximately one and one half times its diameter. The reason for this exaggerated length is to permit the involution of distal portion 18 and neck opening 40 to a location generally between lower perimeter 24 of head opening 20 and approximately the midline of lateral perimeter 26 of head opening 20. Accessory 10 is shown in its fully involuted configuration in FIGS. 3 and 7 wherein distal portion 18 of neck portion 14 is shown in phantom prior to involution and in solid after having been placed in the facial protection position. Thus, by carrying out the involution to varying degrees, the degree of facial covering afforded by distal portion 18 of neck portion 14 can be modified. Furthermore, the degree of modification is independent of the status of hood portion 12 as is illustrated in FIGS. 4–8.

Figure 6:
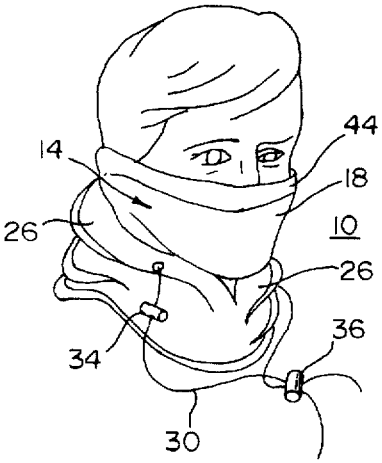
FIG. 6 is a perspective view of the invention when worn by a human showing the invention in a neck tube with lower face mask configuration.

As is best illustrated in FIG. 2, neck opening 40 has hem 44 located at perimeter 42 to accept drawstring 46 in a manner similar to the hem/drawstring combination associated with head opening 20. By progressively withdrawing drawstring 46 from hem 44 and maintaining the relationship with toggle 48, neck opening 40 is caused to progressively constrict. This feature of the invention is especially useful when neck opening 40 terminates in the involuted configuration at or near the user's nose as illustrated in FIGS. 6 and 7. Not only does the constriction assist in preventing neck opening 40 from slipping downwardly towards the neck, thereby exposing the user's mouth, chin, ears, and perhaps nose to the environment, it also beneficially decreases the escapement of the user's breath through the channel created by the nose-cheeks-distal neck portion combination. The constriction is also useful when neck opening 40 is positioned just below the user's nose.

In furtherance of the object to reduce undesirable breath escapement, gasket 50 can be integrated such as by sewing into hem 44 at a location thereon so as to contact a user's face when distal portion 18 is brought in contact therewith. Gasket 50 can be any resilient material such as fabric covered urethane foam or the like. Gasket 50 also may be formed to fit about a user's nose and cheeks to enhance its sealing characteristics.

Additional features of the invention include incorporating a water repellant liner with the material of accessory, or initially choosing a water repellant material. Moreover, upper perimeter 22 of head opening 20 may be extended outwardly to form a bill to reduce the impact of rain, snow, or sun on the user's face.

What is claimed is:

1. A one piece multifunction clothing accessory for selectively covering a human head having an upper scalp portion, a face portion, a rear head portion, and a neck, the accessory comprising:

a hood portion sized to cover the upper scalp portion and rear head portion of a human wearer's head, and to fit substantially conformally thereto, the hood portion defining a first opening sized to permit exposure of the face portion of a human wearer's head and extension of the wearer's head there through;

an elongated neck portion having a substantially cylindrical shape, an interior surface, a diameter sufficient to permit extension of a wearer's head there through, and a length at least approximately one and one half times its diameter; the neck portion having a proximal portion adjacent the hood portion and substantially contiguous thereto, and a distal portion terminating at a second opening; and a first circumferential gathering means located adjacent the second opening for causing the second opening to constrict radially;

wherein the distal portion of the neck portion can be involuted towards the proximal portion to form a face shield positioned at the first opening.

2. The accessory of claim 1, wherein the first circumferential gathering means is disposed inside a hem on the interior surface, so that when the distal portion of the neck portion is involuted towards the proximal portion to form a face shield positioned at the first opening, the hem and gathering means are not substantially in contact with the face portion of a wearer's head.

3. The accessory of claim 1, further comprising a gasket located at the distal portion of the neck portion.

4. The accessory of claim 1, wherein the first gathering means comprises a drawstring.

5. The accessory of claim 1, further comprising a second gathering means located at least partially about the first opening.

6. The accessory of claim 5, wherein the second gathering means comprises a drawstring.

7. A one piece multifunction clothing accessory for selectively covering a human head having an upper scalp portion, a face portion, a rear head portion, and a neck, the accessory comprising:

a hood portion sized to cover the upper scalp portion and rear head portion of a human wearer's head, the hood portion defining a first opening sized to permit exposure of the face portion of a human wearer's head and extension of the wearer's head there through;

an elongated neck portion having a substantially cylindrical shape, an interior surface, a diameter sufficient to permit extension of a wearer's head there through, and a length at least approximately one and one half times its diameter; the neck portion having a proximal portion adjacent the hood portion and a distal portion terminating at a second opening;

a first circumferential gathering means located adjacent the second opening for causing the second opening to constrict radially; and a gasket located at the distal portion of the neck portion;

wherein the distal portion of the neck portion can be involuted towards the proximal portion to form a face shield positioned at the first opening.

8. The accessory of claim 7, wherein the first circumferential gathering means is disposed inside a hem on the interior surface, so that when the distal portion of the neck portion is involuted towards the proximal portion to form a face shield positioned at the first opening, the hem and gathering means are not substantially in contact with the face portion of a wearer's head.

9. The accessory of claim 7, wherein the first gathering means comprises a drawstring.

10. The accessory of claim 7, further comprising a second gathering means located at least partially about the first opening.

11. The accessory of claim 10, wherein the second gathering means comprises a drawstring.

* * * * *

UNITED STATES PATENT AND TRADEMARK OFFICE

CERTIFICATE OF CORRECTION

PATENT NO. : 5,765,230

DATED : June 16, 1998

INVENTOR(S) : Robert D. Sivret and Dave R. Maclaskey

It is certified that error appears in the above-identified patent and that said Letters Patent is hereby corrected as shown below:

ON THE TITLE PAGE, AT COLUMN 1, INSERT:

--RELATED U.S. APPLICATION DATA:

Continuation of Serial No. 08/327,523, filed October 21, 1994, now abandoned.--

AT COLUMN 1, IMMEDIATELY BELOW THE TITLE, INSERT:

--This application is a continuation of prior copending application Serial No. 08/327,523, filed October 21, 1994, and now abandoned, entitled "Multifunction Head Apparel".

Signed and Sealed this

Twenty-fifth Day of May, 1999

*Attest:*

*Attesting Officer*

Q. TODD DICKINSON

*Acting Commissioner of Patents and Trademarks*